US006010365A

United States Patent [19]

Wu et al.

[11] Patent Number: 6,010,365

[45] Date of Patent: Jan. 4, 2000

[54] ELECTRICAL CONNECTOR WITH IMPROVED GROUNDING PROTECTION

[75] Inventors: Kun-Tsan Wu, Tu-Chen; Waiyin Chou, Chung-Ho; Susan Hsu, Hsin-Chu Hsien, all of Taiwan

[73] Assignee: Hon Hai Precision Ind. Co., Ltd., Taipei Hsien, Taiwan

[21] Appl. No.: 09/069,898

[22] Filed: Apr. 29, 1998

[30] Foreign Application Priority Data

Apr. 29, 1997 [TW] Taiwan ..... 86207078

[51] Int. Cl.[7] ..... H01R 13/648

[52] U.S. Cl. ..... 439/607

[58] Field of Search ..... 439/607, 608, 439/609, 92, 95, 108

[56] References Cited

U.S. PATENT DOCUMENTS 5,702,271 12/1997 Steinman ..... 439/676

5,865,646 2/1999 Ortega et al. ..... 439/607

*Primary Examiner*—Steven L. Stephan
*Assistant Examiner*—Eugene G. Byrd

[57] ABSTRACT

An electrical connector for electrically connecting an external mating electrical connector to a circuit board on which the connector is mounted, includes a metallic shell for shielding an insulated housing, having a receiving opening formed on a mating surface thereof for receipt of the mating electrical connector and a pair of board locks formed on opposite bottom edges of the shell for providing a basic grounding protection. Auxiliary grounding means retentively attached to said shell, includes a convex contact portion includes a pair of convex bars and a pair of spring fingers for electrical engagement with a panel of a computer system in which the circuit board and the connector are installed thereby providing the receiving opening of the shell with an enhanced grounding protection wherein the convex bars are further located behind the spring fingers in compliance with different gaps between the panel and the connector.

11 Claims, 5 Drawing Sheets

ELECTRICAL CONNECTOR WITH IMPROVED GROUNDING PROTECTION

BACKGROUND OF THE INVENTION

1. Field of The Invention

The present invention relates to an electrical connector for electrically connecting an external mating electrical connector to a circuit board on which the electrical connector is mounted, and particularly to an electrical connector having an auxiliary grounding means for providing the electrical engagement between the mated connectors with efficient grounding protection.

2. The Prior Art

A conventional electrical connector 5, as shown in FIG. 1, for electrically connecting an external mating electrical connector to a circuit board on which the electrical connector 5 is mounted, includes a metallic shell defined by five sides and enclosing an insulated housing thereby providing the housing with shielding protection from electrostatic discharge (ESD) of an external electrified body. Furthermore, a pair of spaced board locks 51 respectively extend downward from two bottom edges of said shell for retentive insertion into a pair of apertures defined on the circuit board thereby retaining the electrical connector onto the circuit board, and for electrical engagement with a plurality or grounding traces to provide a basic grounding protection from electromagnetic interference (EMI) of adjacent electric devices by means of draining said electrostatic charges accumulating within said metallic shell. One of the sides of the shell forms a mating surface 50 with a rectangular opening 501 for receipt of said external mating electrical connector. However, as shown in FIG. 2, the mating surface 50 of the electrical connector 5 is generally spaced from a back panel 6 of a computer system in a gap "t" when the circuit board is installed within the computer system. As a result, either EMI or ESD may directly invades the rectangle opening 501 through the gap "t" to interfere with the signal transferred between the mated connectors. Therefore, the grounding protection of the conventional connector is imperfect and need to be improved.

Accordingly, to resolve the above problems, an object of the present invention is to provide an electrical connector which is equipped with an auxiliary grounding means for electrical engagement with a panel of a computer system to provide a receiving opening of the connector with an enhanced grounding protection in addition to the basic grounding means of conventional connector wherein said receiving opening receives an external mating electrical connector therein.

Another object of the present invention is to provide an electrical connector having an auxiliary grounding means which is electrically engaged with a panel of a computer system for shortening the grounding path.

A further object of the present invention is to provide an electrical connector with an auxiliary grounding means which includes a contact portion for electrical and resilient engagement with a panel of a computer system in compliance with different gaps between the panel and the connector.

SUMMARY OF THE INVENTION

According to an aspect of the present invention, an electrical connector for electrically connecting an external mating electrical connector to a circuit board on which the connector is mounted, includes an insulated housing, a metallic shell and an auxiliary grounding means. The housing encloses a plurality of contacts therein. The shell is defined by a plurality of sides for shielding said housing and includes a mating surface forming a receiving opening thereon for receipt of the mating electrical connector, a cavity defined on each lateral side of the shell adjacent to the receiving opening, and a pair of board locks formed on opposite bottom edges of the shell for electrical engagement with a number of corresponding grounding traces on the circuit board to provide a basic grounding protection. The auxiliary grounding means includes a convex contact portion having a pair of convex bars and a pair of spring fingers for electrical engagement with a panel of an electrical device in which the circuit board and the connector are installed thereby providing the receiving opening of the shell of the connector with an enhanced grounding protection wherein the convex bars are further located behind the spring fingers in compliance with different gaps between the panel and the connector. A hollow is defined on a central region of the contact portion of the auxiliary grounding means for alignment with the receiving opening of the shell. A reverse tab is formed on each end of the convex contact portion of the shell for cooperating with said corresponding cavity of the housing to retentively attach the grounding means to the shell of the connector.

DETAILED DESCRIPTION OF THE PREFERRED EMBODIMENT

Figure 1:
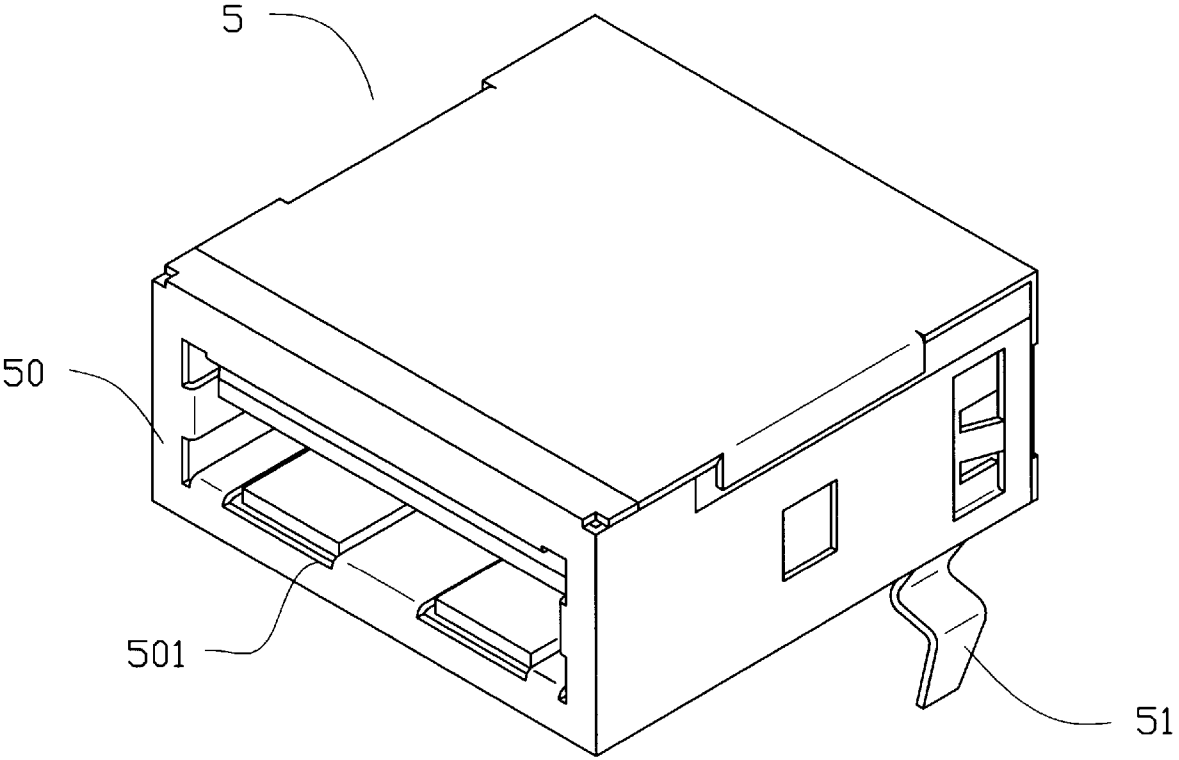
FIG.1 (PRIOR ART)
FIG. 1 is a perspective view of a conventional electrical connector.
Figure 2:
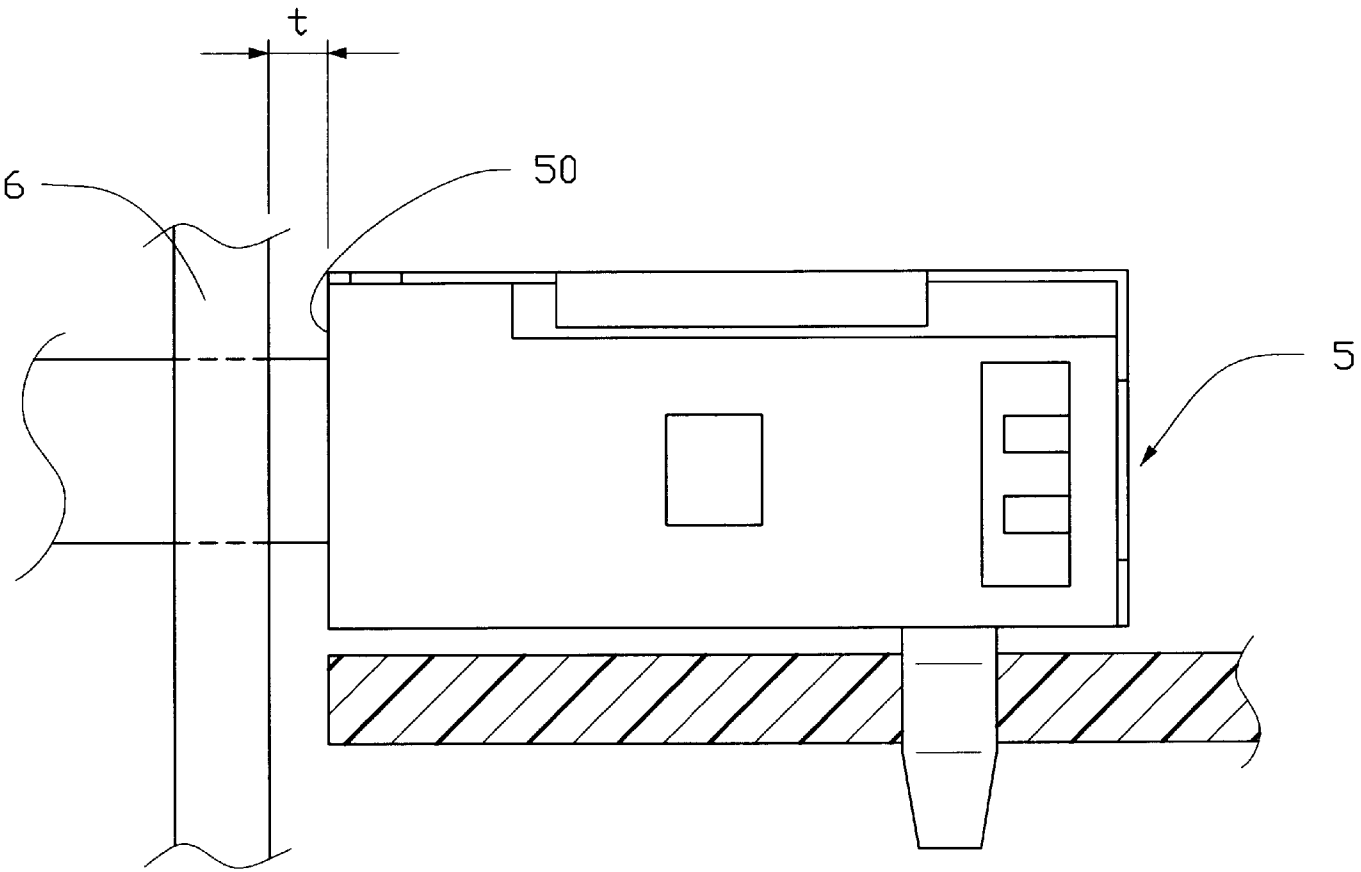
FIG.2 (PRIOR ART)
FIG. 2 is a lateral view of the electrical connector of FIG. 1 showing that the electrical connector is mounted on a circuit board and faces a panel of a computer system.
Figure 3:
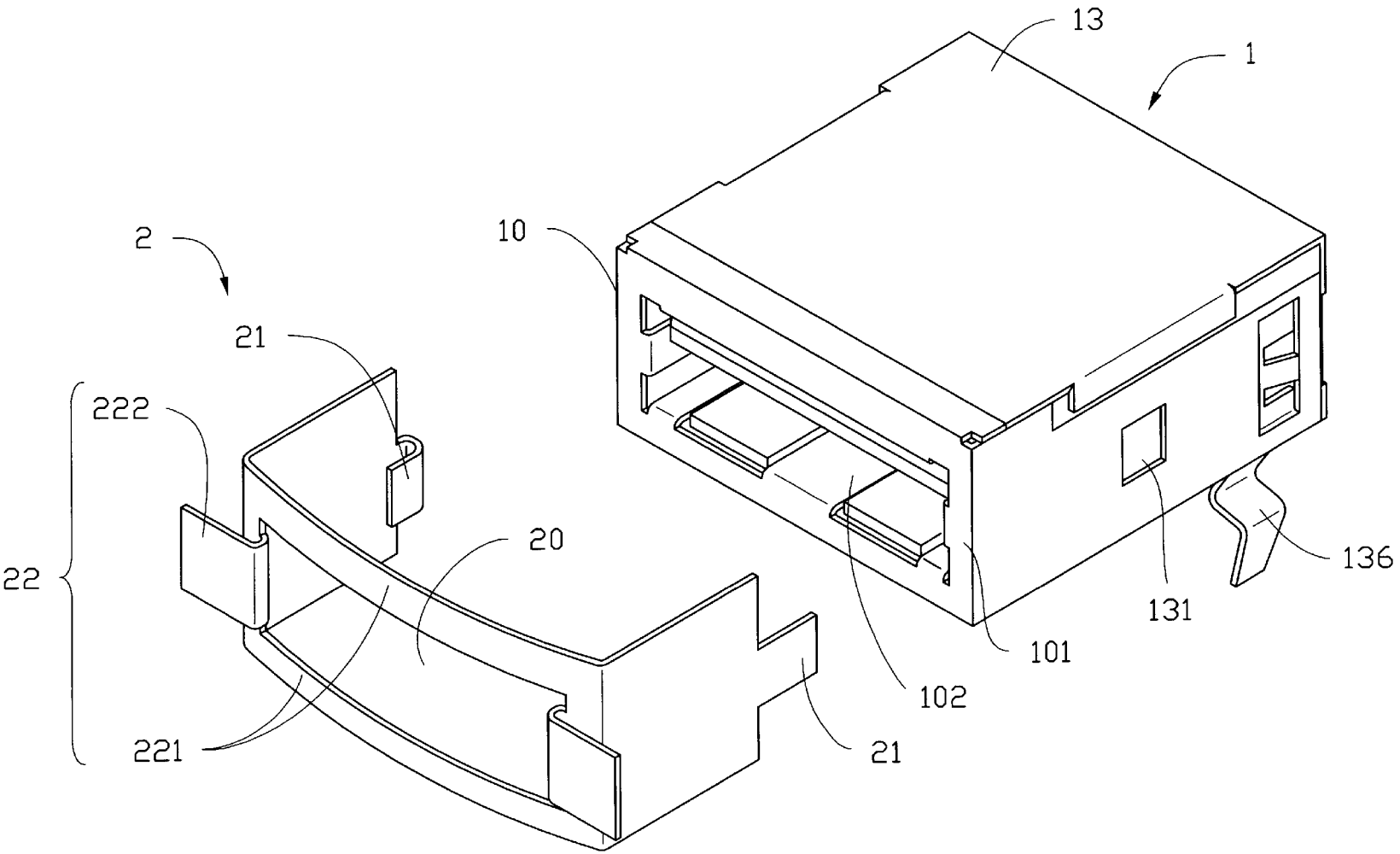
FIG. 3 is a perspective view of an electrical connector in accordance with the present invention showing a separate auxiliary grounding means.
Figure 4:
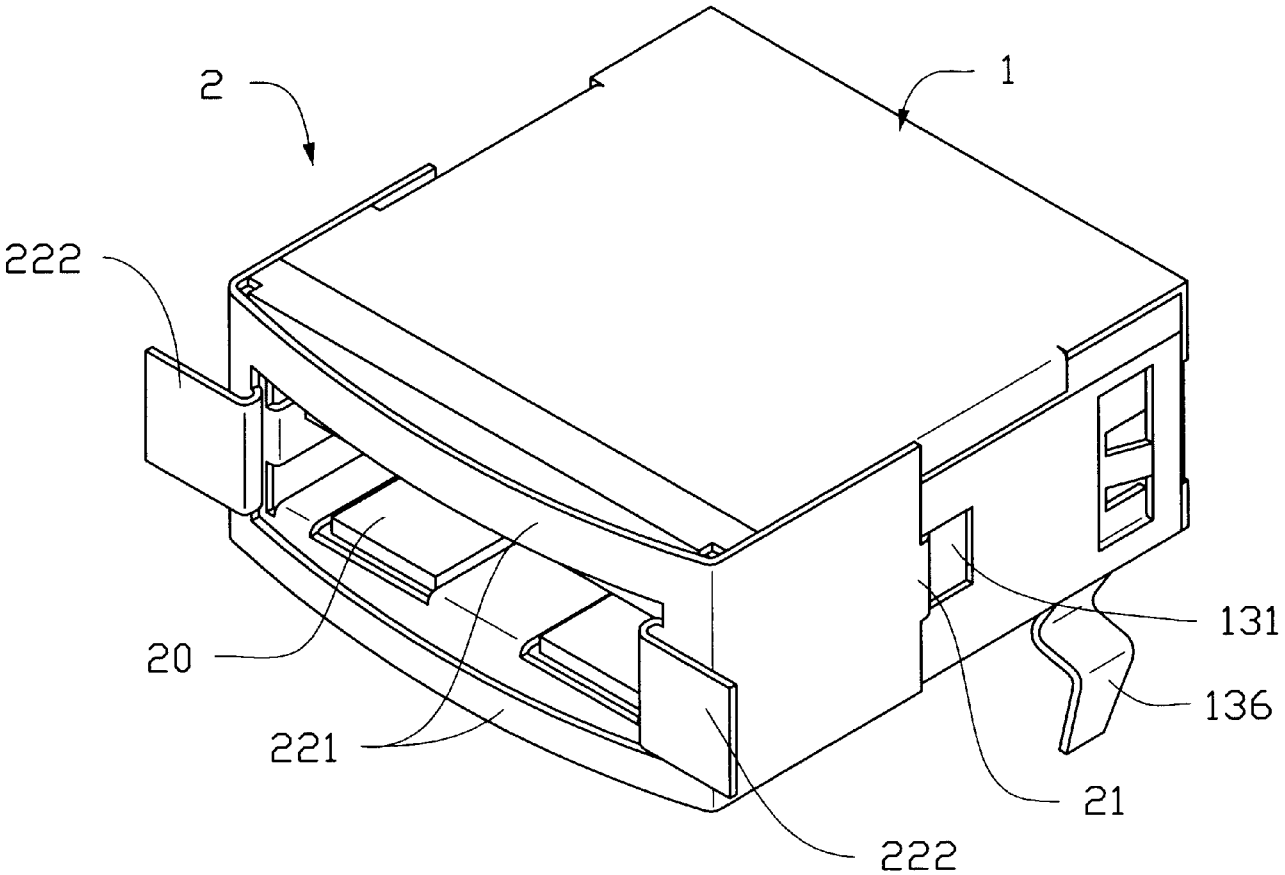
FIG. 4 is a perspective assembled view of the electrical connector of FIG. 3.
Figure 5:
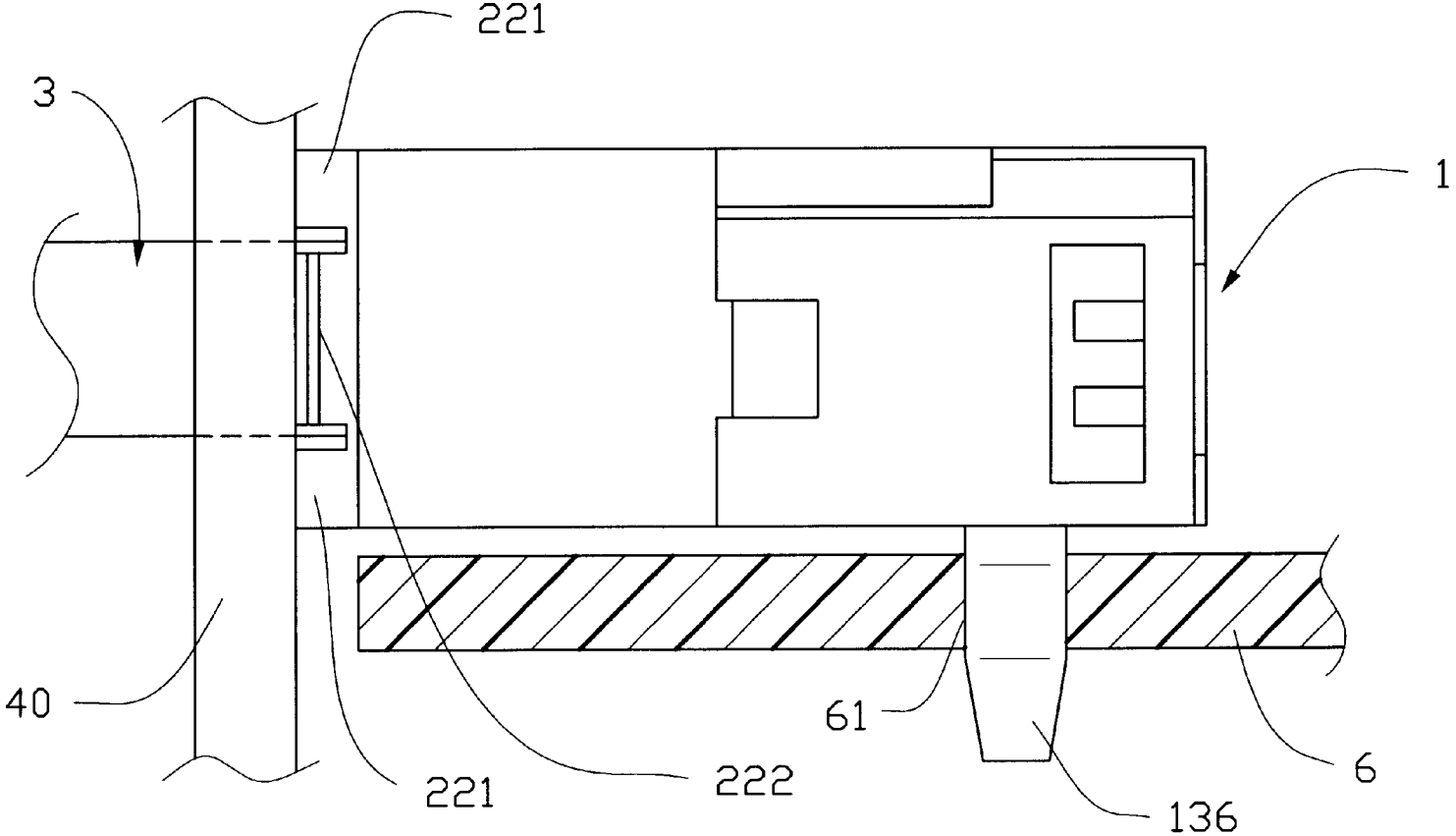
FIG. 5 is a lateral view of the electrical connector of FIG. 4 showing that the electrical connector is mounted on a circuit board and faces a panel of a computer system.

References will now be made in detail with regard to the preferred embodiment of the present invention. Referring to FIGS. 3–5, an electrical connector 1 for electrically connecting an external mating connector 3 to a circuit board 6 on which the connector 1 is mounted, includes a metallic shell 13 defined by five sides and enclosing an insulated housing 10 for providing a shielding protection to the connector 1 wherein the housing 10 encloses a plurality of contacts therein. Furthermore, a pair of spaced board locks 136 respectively extend downward from opposite bottom edges of said shell 13 for retentively cooperating with a pair of apertures 61 defined on the circuit board 6 thereby retaining the electrical connector 1 on the circuit board 6, and for electrical engagement with a plurality of grounding traces (not shown) thereby providing a basic grounding protection from EMI/ESD. One of the sides of the shell 13 includes a mating surface 101 defining a rectangular receiving opening 102 thereon for alignment with another opening (not shown) defined on a front surface of the housing 10 for receipt of said external mating electrical connector 3. A cavity 131 is defined on each lateral side of the shell 13 adjacent to the receiving opening 102.

An auxiliary grounding means 2 fabricated from a sheet metal plate and functioning as a mask to cover said mating surface 101 of the shell 13, includes a convex contact portion 22 which is defined by a pair of horizontal convex bars 221 and a pair of spaced spring fingers 222. A hollow 20 defined on a central region of the convex contact portion 22, is surrounded by the convex bars 221 and spring fingers 222 wherein the pair of spring fingers 222 are virtually stamped from opposite lateral ends of the hollow 20 and extend outward at a specific angle, and the pair of convex bars 221 are respectively formed adjacent to top and bottom edges of the hollow 20. Said hollow 20 is designed to be aligned with the receiving opening 102 of the shell 13. It is noted that the bars 221 are located behind the spring fingers 222. An extension portion (not labeled) extends rearward from each end of the convex contact portion 22 and forms a reverse tab 21 at each distal end thereof by a bending process. In FIG. 3, only one tab 21 has been bent and another tab 21 remains in a straight status before said bending process is performed thereon.

In assembly, by means that the reverse tabs 21 of the auxiliary grounding means 2 are advantageously locked with the cavities 131 of the shell 13, the auxiliary grounding means 2 is stably and firmly assembled with the shell 13 as shown in FIG. 4.

Consequently, when the electrical connector 1 in accordance with the present invention is mounted on the circuit board 6 and both are further installed within a computer system (not shown), the convex bars 221 are firstly compressed by a panel 40 of the computer system. Then the spring fingers 222 are further compressed by the panel 40 to form an enhanced grounding protection around the receiving opening 102 of the shell 13 in addition to the basic grounding protection provided by the board locks 136. As a result, the grounding path of the electrical connector 1 is more shortened than that of the conventional connector which is originally designed from the board locks 136 to the grounding traces on the circuit board 6. In addition, based on the aforementioned, since the convex bars 221 are located behind the spring fingers 222, the spring fingers 222 can be used for compliance with a large gap between the panel 40 and the connector 1.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

We claim:

1. An electrical connector for electrically connecting an external mating electrical connector to a circuit board on which the connector is mounted, comprising:

an insulated housing having a plurality of contacts;

a metallic shell for enclosing said housing, having a receiving opening for receipt of the mating electrical connector and at least a cavity adjacent to the receiving opening; and grounding means fabricated from a sheet metal plate and including a convex contact portion having at least a flexible convex bar and a spring finger for electrical engagement with a panel of an electrical device in which the circuit board and the connector are installed, and a tab formed on an end of said convex contact portion and cooperating with said cavity of the housing for retentively attaching the grounding means to the shell of the connector whereby the convex bar and spring finger are successively located in front of the opening to comply with variation of different gaps between the panel and the connector thereby providing an enhanced grounding protection is formed around the receiving opening of the shell of the connector through a shortened grounding path.

2. The electrical connector as described in claim 1, wherein a pair of board locks are integrally formed with opposite bottom edges of the shell for retaining the connector on the circuit board and providing the connector with a basic grounding protection.

3. The electrical connector as described in claim 1, wherein said contact portion of the grounding means defines a hollow on a central region thereof for alignment with said receiving opening of the connector.

4. The electrical connector as described in claim 3, wherein said hollow is surrounded by the convex bar and the spring finger.

5. The electrical connector as described in claim 3, wherein said spring finger is virtually stamped from a lateral end of the hollow and extends outward at a specific angle.

6. The electrical connector as described in claim 3, wherein the convex bar is formed adjacent to one of the top and bottom edges of the hollow.

7. An electrical connector for electrically connecting an external mating electrical connector to a circuit board on which the connector is mounted, comprising:

an insulated housing having a plurality of contacts;

a metallic shell for enclosing said housing, having a receiving opening thereon for receipt of the mating electrical connector; and grounding means retentively attached to the shell and including a convex contact portion having at least a flexible convex bar and a spring finger thereby electrically engaging with a panel of an electrical device in which the circuit board and the connector are installed thereby providing the receiving opening of the shell of the connector with grounding protection;

wherein the convex bar is located behind the spring finger in compliance with variation of different gaps between the panel and the connector.

8. The electrical connector as described in claim 7, wherein the shell further includes at least a cavity adjacent to the receiving opening.

9. The electrical connector as described in claim 8, wherein said convex contact portion further includes a tab formed on an end thereof for cooperating with said cavity of the shell to retentively attach the grounding means to the shell of the connector.

10. A grounding means for being adapted to be positionable in front of a connector having a housing and a shell generally enclosing said housing, comprising:

a convex contact portion defining a hollow in alignment with a receiving opening of the shell, said convex contact portion further including at least one convex bar positioned adjacent to one of top and bottom edges of the hollow and at least one spring finger formed adjacent to one of two opposite lateral ends of the hollow.

11. The grounding means as described in claim 10, wherein at least one extension portion extends rearward from one lateral end of the convex contact portion and forms a reverse tab at a distal end thereof.

* * * * *